United States Patent [19]

Ito et al.

[11] Patent Number: 4,506,882

[45] Date of Patent: Mar. 26, 1985

[54] DEVICE FOR PLACING BANKNOTES WITH THEIR FRONT OR REVERSE SIDES FACING IN THE SAME DIRECTION

[75] Inventors: Yukio Ito, Fujisawa; Yoshihiro Koshio, Odawara, both of Japan

[73] Assignees: Musashi Co., Ltd., Tokyo; Hitachi Engineering Kabushiki Kaisha, Kanagawa, both of Japan

[21] Appl. No.: 449,657

[22] Filed: Dec. 14, 1982

[30] Foreign Application Priority Data

Dec. 21, 1981 [JP] Japan ..... 56-189369[U]

[51] Int. Cl.[3] ..... B65H 29/00

[52] U.S. Cl. ..... 271/303; 271/186; 271/187; 271/315

[58] Field of Search ..... 209/534, 540–542, 209/545, 551; 271/185, 186, 187, 315, 303

[56] References Cited

U.S. PATENT DOCUMENTS 4,200,278 4/1980 Gindri ..... 271/186 X 4,326,636 4/1982 Kawakami ..... 209/583 X

*Primary Examiner*—Richard A. Schacher

*Attorney, Agent, or Firm*—Brooks Haidt Haffner & Delahunty

[57] ABSTRACT

A device for placing banknotes with their front or reverse sides in the same direction is comprised of a front-reverse side checker for sensing the front or reverse sides of the banknotes, route selecting means for changing the route of the banknotes, and a pair of vane wheels consisting of an upper vane wheel and a lower vane wheel rotating in mutually opposite directions. The banknotes whose routes are changed by the route selecting means are selectively supplied to the one or the other of said vane wheels so as to be placed ultimately within a downstream stacker with their front or reverse sides facing in the same direction.

2 Claims, 1 Drawing Figure

DEVICE FOR PLACING BANKNOTES WITH THEIR FRONT OR REVERSE SIDES FACING IN THE SAME DIRECTION

BACKGROUND AND SUMMARY OF THE INVENTION

This invention relates to a device for putting banknotes in order as to their front or reverse sides and, more particularly, to a novel structure whereby the banknotes may be checked whether they are being transferred with their front sides facing upwards or their reverse sides facing upwards, and the banknotes may then be placed with their front or reverse sides facing in the same direction.

The operation of putting banknotes in order in this manner required a manual operation and hence considerable time and expense. Therefore, a demand has arisen for improving the efficiency of the operation for putting the banknotes in order.

It is therefore an object of the present invention to provide a device for placing banknotes with their front and reverse sides facing in the same direction which is fully effective to meet the above demand. The device according to the present invention for placing the banknotes with their front and reverse sides in the same direction is comprised of a front-reverse side checker for sensing the front or reverse sides of the banknotes, route selecting means for changing the route of the banknotes and a pair of vane wheels consisting of an upper vane wheel and a lower vane wheel rotating in mutually opposite directions, the banknotes being selectively supplied to the one or the other of said vane wheels so as to be placed in a stacker with their front and reverse sides facing in the same direction.

BRIEF DESCRIPTION OF THE DRAWING

This invention will become more readily apparent from the following description of a preferred embodiment thereof shown, by way of example only, in the accompanying drawing, which illustrates as an overall side elevation the device for putting banknotes in order as to front and reverse sides according to the present invention.

DESCRIPTION OF THE PREFERRED EMBODIMENT

Figure 1:
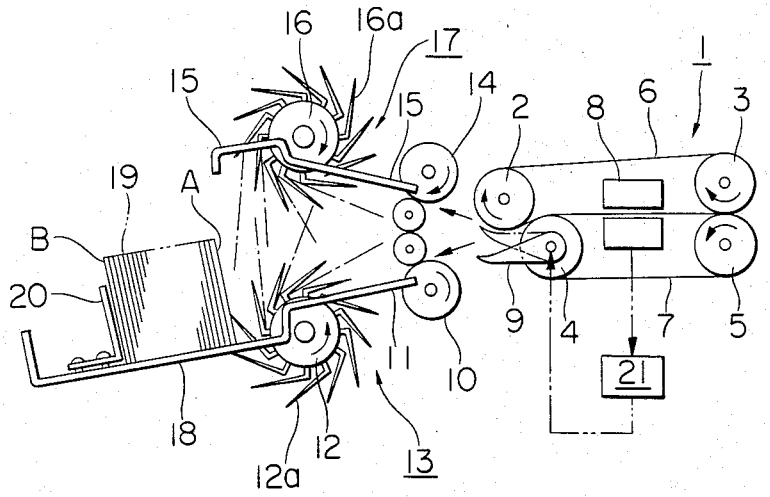

In the drawing, numeral 1 designates a substantially horizontal transfer unit comprised of a pair of guide rolls 2, 3 mounting a first supply belt 6 and another pair of guide rolls 4, 5 mounting a second supply belt 7. A front-reverse side checker 8 is mounted centrally of the transfer unit 1.

A route selector comprised of at least one branch guide 9 is mounted on the exit side roll 4 of the second supply belt 7 coaxially with and for rotation about the axis of the roll 4. An output signal from the front-reverse side checker 8 is supplied through a control unit 21 to a solenoid associated with the branch guide 9, not shown, said branch guide 9 being thereby rotated from the solid line position to the dotted line position. The branch guide 9 constitutes a branch unit.

Adjacent to the branch guide 9, there are mounted a first feed-in unit 13 comprised of a first supply roll 10, a first guide plate 11 and a first vane wheel 12, and a second feed-in unit 17 comprised of a second feed roll 14, a second guide plate 15 and a second vane wheel 16, in a vertically superposed relation and substantially parallel to the transfer unit 1. The supply rolls 10, 14 are designed to rotate in opposite directions, as are the vane wheels 12, 16 as indicated by respective arrow marks. A hopper 18 is mounted adjacent to the feed-in units 13, 17 and an upright guide member 20 is mounted on the hopper 18 movably with respect to the hopper bottom for holding the banknotes.

In the operation of the present banknote arranging device, described above, the banknotes are supplied by the first and second supply belts 6, 7 of the transfer unit 1 and are checked by the front-reverse side checker 8 as to whether they are resting with the front sides facing upwards. In the event that a banknote is being transferred with the reverse side facing upwards, the branch guide 9 is rotated from the solid-line position to the double-dotted chain line position through control unit 21 and the solenoid, not shown, so that the banknote is delivered to the upper route, that is, towards the lower side of the second guide plate 15 of the second feed-in unit 17. Since the second vane wheel 16 provided with a number of vanes **16*a* is provided at the downstream side of the second route and rotated at a rotational speed coincident with the transfer speed of the banknotes, these banknotes are held between a pair of adjoining vanes 16*a* and thereby changed in direction with continued rotation of the second vane wheel 16. The upper edge of the banknote impinges on the second guide plate 15 so that the banknote is disengaged from the vanes 16*a* and forced to descend on the hopper 18. In this manner, a banknote transferred through the unit 1 in the reversed state has its front side directed in the forward direction by being gripped by the second vane wheel 16 and being impinged on the second guide plate 15. This banknote is then acted upon by one of the vanes 12*a* of the first vane wheel 12 and accommodated in the hopper 18 in substantially vertical position. In this manner, the banknotes are adjusted spontaneously in height within the hopper 18**.

In the case of the banknote transferred through the unit 1 in the normal state, that is, with the front side facing upwards, the output signal from the checker 8 does not energize the solenoid, not shown, and therefore the branch guide 9 is positioned as shown by the solid line in the drawing. Hence, the banknote is supplied into the lower route and thus introduced to a zone intermediate two adjoining vanes **12*a* of the first vane wheel 12 by means of the first feed roll 10 and through the first guide plate 11 of the first feed-in unit 13 and thereby gripped in the normal state. The banknote is then changed in direction, as a result of rotation of the second vane wheel 12 until the lower edge of the banknote is impinged on the hopper 18 and thereby disengaged from the vanes. The note is then acted upon by the next following vane 12 and disposed ultimately in the hopper 18**.

In this manner, the notes 19 disposed in the hopper 18 are stacked with their reverse sides towards the right side A and their front sides towards the left side B, irrespective of whether the notes are supplied to the transfer unit 1 in the normal or reversed state.

In the construction and operation of the present banknote arranging device as shown and described hereinabove, the banknotes being transferred at an elevated speed may be easily changed in direction by the vanes, in other words, may be changed between their normal and reversed states, and stacked vertically in the receiving hopper. In the event that banknotes of several different nominal values are being supplied to the arranging device, they may be put in order as to the front or reverse sides, irrespective of banknote size. In addition, owing to the provision of the upper and lower vanes, the banknotes may be disposed in the hopper as they are acted upon by the lower vane wheel no matter whether the banknotes have been delivered through the upper or lower routes. In this manner, the banknotes may be disposed in the hopper with the lower short sides resting correctly on the hopper, assuming that the notes have been supplied to and transferred through the transfer unit 1 with the short sides as leading and trailing edges. There is no necessity for aligning the short sides of the notes by a special alignment device with resultingly simplified hopper structure.

When installed in the bank, the present arranging device contributes greatly to savings in time and labor involved in the banking operation since it enables the banknote to be put in order automatically as to their normal or reversed states.

What is claimed is:

1. A device for placing banknotes in a stacker with their front or reverse sides facing in the same direction, said stacker having an open end for receiving said banknotes, said device comprising a substantially horizontal transfer unit adapted for transferring the banknotes, a checking unit for sensing whether the banknotes are being supplied through said transfer unit with their front sides facing upwards or their reverse sides facing upwards, route selecting means provided on an exit side of said transfer unit and capable of being rotated alternately between a first position thereof and a second position thereof above said first position in response to respective front-side signals and reverse-side signals received from said checking unit, and a pair of vane wheels consisting of an upper vane wheel and a lower vane wheel, said lower vane wheel being disposed adjacent to said stacker open end, and said vane wheels rotating in mutually opposite directions for respectively conveying the banknotes received from the respective of said positions of said route selecting means to said open end of said stacker, said banknotes transferred through said transfer unit being supplied to said lower one of said vane wheels when said route selecting means is in its said first position and to said upper vane wheel when said route selecting means is in its said second position, the direction of rotation of said lower vane being such as to direct the banknotes supplied thereto into said stacker with their front sides facing in one direction, and said opposite direction of rotation of said upper vane wheel directing the banknotes supplied thereto towards said stacker with their front sides facing in said direction.

2. The device as claimed in claim 1, wherein said upper vane wheel is so positioned with respect to said lower vane wheel that banknotes exiting therefrom and falling towards said stacker are impinged by vanes of said lower vane wheel and are thereby urged into said stacker by said lower vane wheel.

* * * * *

UNITED STATES PATENT AND TRADEMARK OFFICE

CERTIFICATE OF CORRECTION

PATENT NO. : 4,506,882

DATED : March 26, 1985

INVENTOR(S) : YUKIO ITO et al

It is certified that error appears in the above-identified patent and that said Letters Patent is hereby corrected as shown below:

On the title page;

[73] Assignees: should read --Musashi Co., Ltd., Tokyo; Hitachi Denshi Engineering Kabushiki Kaisha, Kanagawa, both of Japan--

Signed and Sealed this

*First* Day of *October 1985*

[SEAL]

*Attest:*

DONALD J. QUIGG

*Attesting Officer*

*Commissioner of Patents and Trademarks—Designate*